US006823942B1

(12) United States Patent
McGee

(10) Patent No.: US 6,823,942 B1
(45) Date of Patent: Nov. 30, 2004

(54) TREE SAVER

(76) Inventor: Richard Harvey McGee, 7603 Fernbrook La., Houston, TX (US) 77064

( * ) Notice: Subject to any disclaimer, the term of this patent is extended or adjusted under 35 U.S.C. 154(b) by 28 days.

(21) Appl. No.: 10/345,647

(22) Filed: Jan. 16, 2003

Related U.S. Application Data

(60) Provisional application No. 60/353,562, filed on Feb. 1, 2002.

(51) Int. Cl.[7] ..... E21B 29/12

(52) U.S. Cl. ..... 166/379; 166/77.51; 166/90.1

(58) Field of Search ..... 166/379, 90.1, 166/77.51, 80.1, 70, 72

(56) References Cited

U.S. PATENT DOCUMENTS 4,184,504 A * 1/1980 Carmichael et al. ..... 137/15.17
4,241,786 A * 12/1980 Bullen ..... 166/77.4
4,867,243 A * 9/1989 Garner et al. ..... 166/379
4,991,650 A * 2/1991 McLeod ..... 166/72
5,285,852 A * 2/1994 McLeod ..... 166/379
6,591,913 B2 * 7/2003 Reaux et al. ..... 166/352

* cited by examiner

*Primary Examiner*—William Neuder
(74) *Attorney, Agent, or Firm*—Wendy Buskop; Buskop Law Group, P.C.

(57) ABSTRACT

The invention is a tree saver apparatus for preventing excess pressure on a Christmas tree for a well, wherein the Christmas tree has tubing, a master valve, a top valve, a second master valve, a wing valve, and wherein the apparatus has a connection with at least 3 outlets connected to the cylinder, a frac wing valve connected to the connection with at least 3 outlets, a frac valve connected to the connection with at least 3 outlets, a mandrel connected to the piston rod, a landing bowl connected to the top valve, and a hydraulic system with a piston, a cylinder, an upper plunger, and a hand wheel.

6 Claims, 5 Drawing Sheets

TREE SAVER

The present application claims priority to Provisional Patent Application Ser. No. 60/353,562 filed in the U.S. Patent and Trademark Office on Feb. 1, 2002.

BACKGROUND OF THE INVENTION

Field of the Invention

The invention relates to a device and a method for preventing excess pressure on a Christmas tree; and for extending the life of a Christmas tree.

This invention relates generally to apparatus for use in drilling and completing oil and natural gas wells to prevent excess pressure from building on various valves, including wing valves, master valves, and tubing spools.

More particularly, the invention relates to improvements in apparatus of a type in which the flow of well fluid within the Christmas tree is controlled by valve means within a passageway in the Christmas tree. In the drilling and completion of a well of the type contemplated by this invention, a relatively large diameter sleeve is normally used and is difficult and costly to install. To reduce costs, and maintenance on a tree, a device has been developed which fits within the Christmas tree, essentially, a sleeve is installed within the bore of the Christmas tree housing, which is easy and fast to use.

In the preferred and illustrated embodiment of the invention, a first tube or sleeve is lowered onto and release ably connected to the middle portion of the Christmas tree. This sleeve permits a high velocity high pressure flow stream to pass through the Christmas tree without damaging the various valves off the sides of the Christmas tree.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

For purposes of promoting an understanding of the principles of the invention, reference will now be made to the embodiments illustrated in the drawings and specific language will be used to describe same. It will nevertheless be understood that no limitation of the scope of the invention is thereby intended. Alterations and modifications of the illustrated device are contemplated, as are such further applications of the principles of the invention as would normally occur to one skilled in the art to which the invention pertains.

SUMMARY OF THE INVENTION

The invention overcomes the previous art by providing a tree saver apparatus for preventing excess pressure on a Christmas tree for a well. The Christmas tree has tubing, a master valve, a top valve, a second master valve, a wing valve. The apparatus of the inventions has a hydraulic system with a piston, a cylinder, an upper plunger, and a hand wheel. The apparatus also has a connection with at least 3 outlets connected to the cylinder, a frac wing valve connected to the connection with at least 3 outlets, a frac valve connected to the connection with at least 3 outlets, a mandrel connected to the piston rod, and a landing bowl connected to the top valve.

The invention is also a method for extending the life of a Christmas tree that connects to tubing.

BRIEF DESCRIPTION OF THE DRAWINGS

The accompanying drawings illustrate a complete embodiment of the invention according to the best mode so far devised for the practical application of the principles thereof, and in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments and that it can be practiced or carried out in various ways.

The invention relates to a device for reducing the needed maintenance on a Christmas tree with a unique method of isolating pressure on valves of the Christmas tree. The Christmas Tree has a 5000 psi working pressure and the well frac pressure typically is at least 10,000 psi. This invention enables an operator or user to put the higher and otherwise damaging 10,000 psi through the Christmas tree without damaging the valves or seals on the Christmas tree.

The production operation of an oil well the ground often requires fracing. Fracing means a cracking of the ground with fluid pressure injected into the ground through the well. Fracing facilitates greater production from the well once the high pressure is removed. Using fracing, oil and/or gas can run into the frac from the dense material that holds the oil or gas. Since a higher fluid pressure is required to frac the ground than to operate a normal oil well, adding pressure to a well through a normal christmas tree typically destroys the christmas tree.

In an embodiment, a tree saver is used to insert a mandrel inside of the christmas tree. The mandrel is capable of handling the increased pressure required for fracing. The mandrel isolates the tree and all of the tree components from the high pressure required to frac the ground. Once the well pressure is restored to a pressure that is within the operating pressure of the christmas tree, the tree saver is used to remove the mandrel and then the tree saver itself is removed. One the tree saver is removed, the components that make up the christmas tree are not damaged and can continue to operate the well.

Figure 1:
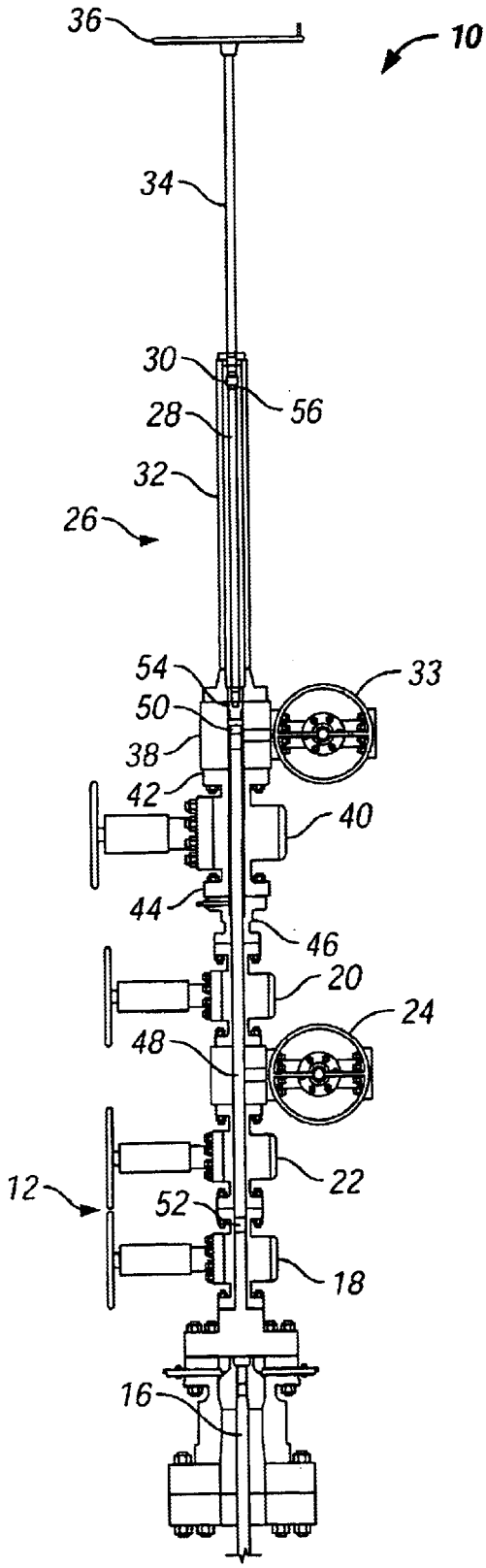
FIG. 1 is a side view of the tree saver as it is installed on a Christmas Tree.

FIG. 1 shows the unique Christmas tree "saver" 10. The tree saver apparatus 10 prevents excess pressure on a Christmas tree 12 when an operator needs to perform a production procedure on a well.

Typically a Christmas tree 12 has tubing 16, a master valve 18, a top valve 20, a second master valve 22, and a wing valve 24.

The tree saver apparatus 10 attaches to the Christmas tree 12 and installs within the Christmas tree.

The tree saver apparatus 10 has a hydraulic system 26 with a piston 30 connected to a piston rod 28. A cylinder 32 is connected to the piston 30. An upper plunger 34 is also connected to the piston 30. A hand wheel 36 connects to the upper plunger 34 to manually engage the upper plunger 34. The piston rod has a first and 54 and a second end 56. Piston rod second end 56 engages upper plunger 34.

A connection 38 having at least 3 outlets is connected to the cylinder 32. A frac wing valve 33 connects to the connection having at least 3 outlets.

A frac valve 40 having a first port 42 and a second port 44 connects to the connection having at least 3 outlets 38, specifically, the first port 42 connects to the connection 38 having at least 3 outlets at one outlet. Frac wing valve 33 is disposed between the piston 30 and the frac valve 40.

A mandrel 48 with a first end 50 and second end 52 connects to the piston rod 28, and specifically the first end 50 connects to the piston rod 28. A landing bowl 46 connects the tree saver apparatus to the top valve 20 and the second port 44.

The piston rod 28 is designed to have a piston rod first end 54 connecting to the mandrel and a piston rod second end 56 connecting to the piston.

The invention also relates to a method for extending the life of a Christmas tree.

Figure 2:
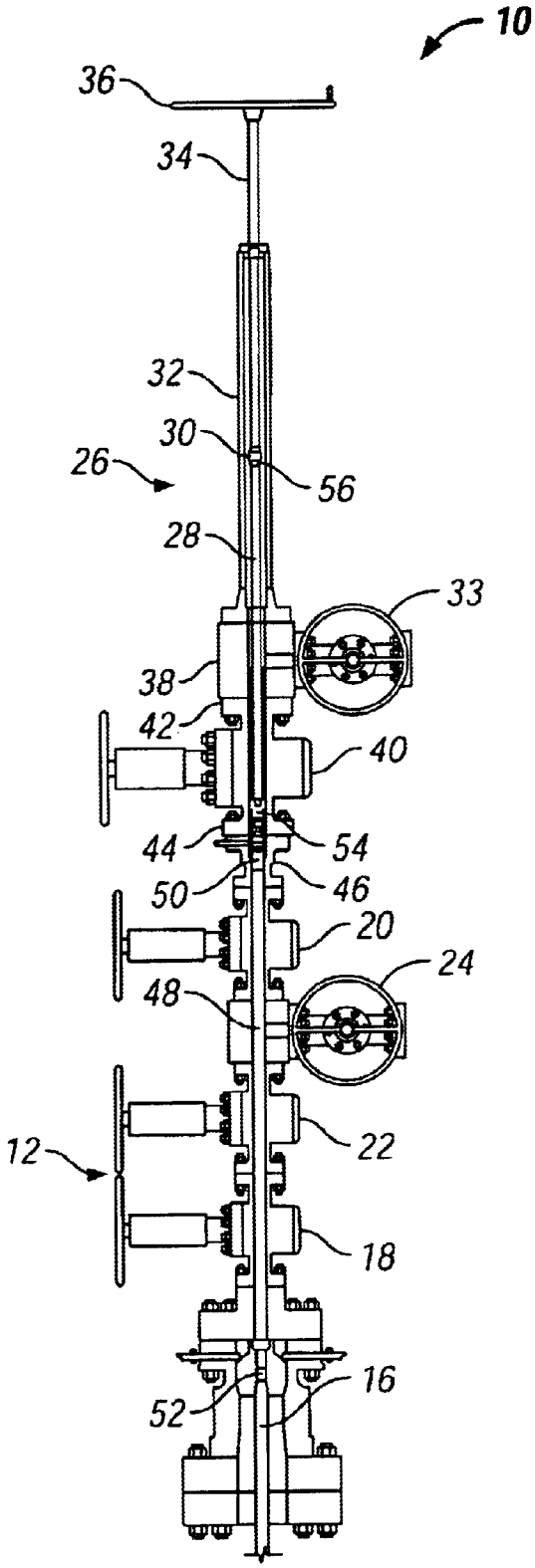
FIG. 2 is a side view of the tree saver apparatus as it is installed.
Figure 3:
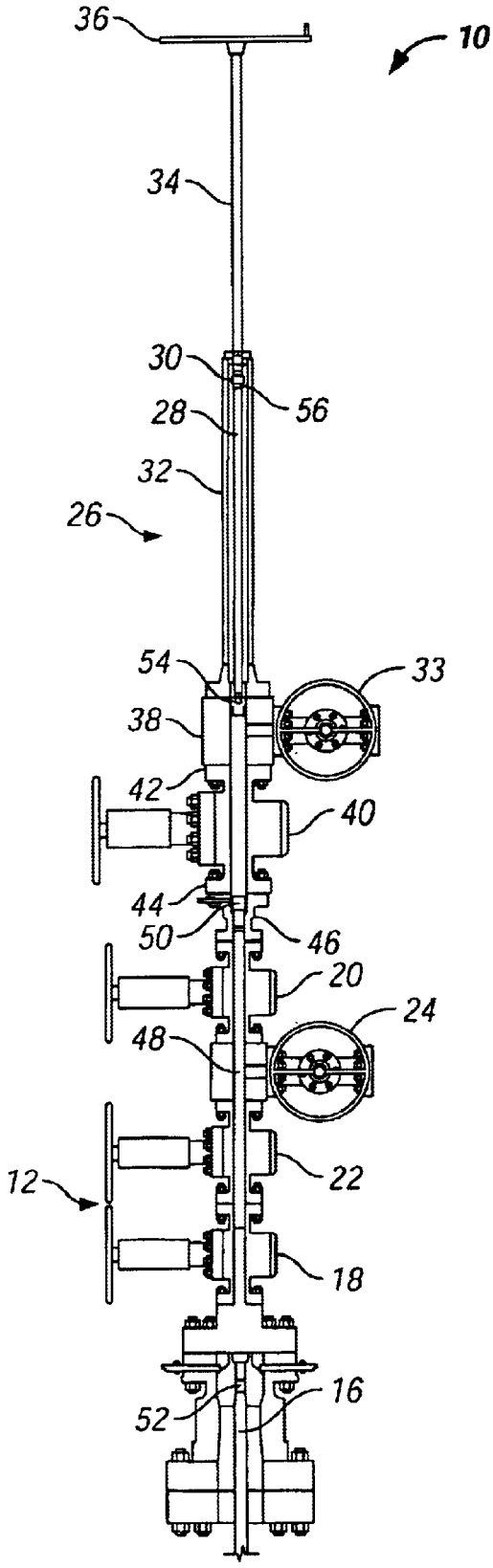
FIG. 3 a side view of the tree saver installed during a frac operation.

Referring to FIG. 1, FIG. 2, and FIG. 3, the method involves the steps of a. closing a master valve 18 of the Christmas tree 12 reducing pressure above the master valve to zero;

b. installing a tree saver apparatus 10 on the Christmas tree 12 by connecting a landing bowl 46 to a top valve 20, wherein the tree saver apparatus 12 has:

i a hydraulic system 26 comprising a piston 30 connected to a piston rod 28, a cylinder 32 connected to the piston 30, an upper plunger 34 connected to the piston 30; a hand wheel 36 connected to the upper plunger 34;

ii a connection 38 having at least 3 outlets which is connected to the cylinder 32;

iii a frac wing valve 33 connected to the connection having at least 3 outlets 38;

iv a frac valve 40 having a first port 42 and a second port 44, wherein the first port 42 is connected to the connection having at least 3 outlets 38 and the second port 44; and v a mandrel 48 with a first end 50 and second end 52, wherein the first end 50 is connected to the piston rod 28;

c. opening the master valve to pressure the Christmas tree and the tree saver apparatus;

d. hydraulically moving the piston in the cylinder to contact landing bowl 46;

e. locking the landing bowl 46 to top of mandrel 48;

f. unscrewing the piston rod first end 54 from first end 50 of the mandrel 48;

g. hydraulically move the piston in the cylinder to disengage landing bowl 46;

h. performing a production procedure;

i. upon completion of the production procedure, moving the piston using hydraulic system to reattach piston rod first end 54 with first end of mandrel 50;

j. releasing the first end of mandrel 50 from landing bowl 46;

k. moving the piston to disengage the mandrel from the tubing 16 at a point above the master valve 18;

l. closing the master valve 18;

m. bleeding off the pressure from the master valve; and n. removing the tree saver apparatus.

It should be noted that the production procedure contemplated by this invention is the procedure known as fracing the well.

FIG. 2 shows the tree saver apparatus 10 landed on a Christmas tree 12. From top to bottom of the figure, the hand wheel 36 connects to upper plunger 34. The upper plunger 34 engages the hydraulic system 26 which comprises the cylinder 32, connected to the piston 30 and the piston rod 28 which has piston rod second end 56.

The frac wing valve 33 is secured to the hydraulic system 26. The frac wing valve 33 connects to one of the three outlets on connection 38. The connection 38 connects to a first port 42 of the frac valve 40.

The piston rod first end 54 penetrates to the second port 44 of the frac valve 40. The landing bowl 46 communicates with the second port 44.

The mandrel 48 is shown having a first end 50 adjacent landing bowl 46 which connects with the second port 44 of the frac valve 40. The mandrel engages top valve 20 and second master valve 22. Between top valve 20 and second master valve 22 is disposed a wing valve 24 in fluid communication with the other two valves, 22 and 20.

The Christmas tree 12 has second master valve 22 and a master valve 18. The mandrel second end 52 is also shown connecting to tubing 16.

FIG. 3 showing the tree saver apparatus while a production procedure is being performed, such as a frac operation. The same parts are used in FIG. 3 as in FIG. 1 and FIG. 2.

Once the mandrel (48) is in position shown in FIG. 3, the mandrel has connected the tubing (16) to the frac valve (40) directly. By connecting the tubing (16) to the frac valve (40), pressure is prevented from coming in contact with any of the christmas tree components between the tubing (16) and the frac valve (40). High pressure hoses are connected to the frac wing valve (33) to supply the pressure needed to frac the ground. The high pressure hoses are used to remove the pressure before the mandrel (48) and the tree saver are removed.

Figure 4:
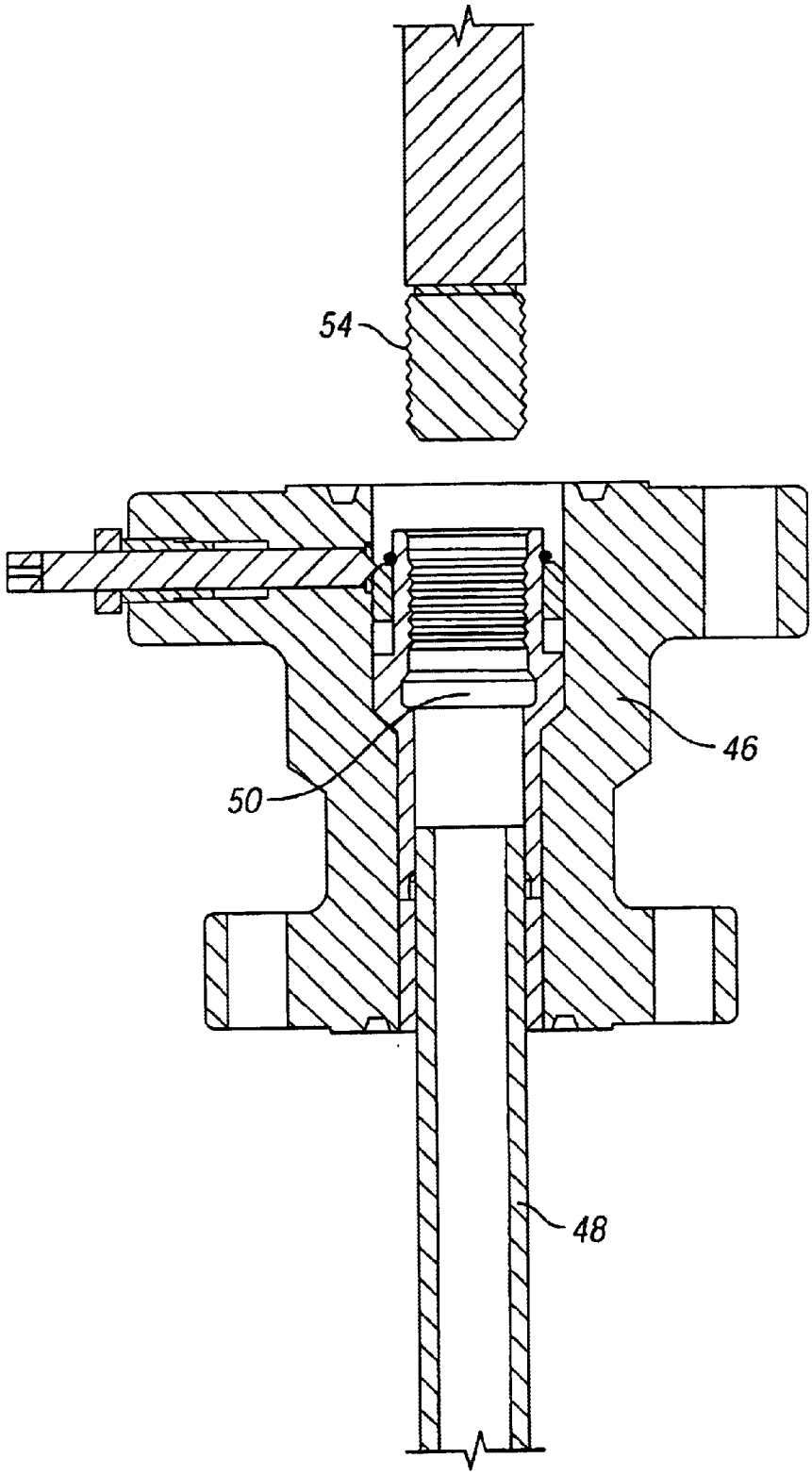
FIG. 4 is a detail of the landing bowl containing the mandrel as it engages the piston rod.

As shown in FIG. 4, in a preferred embodiment, the piston rod first end 54 is a thread able male engagement with a thread able female mandrel first end 50. In yet another embodiment of the invention, the thread able engagements are ACME threads. Also shown in the detail of FIG. 4, landing bowl 46 surrounds mandrel 48.

Figure 5:
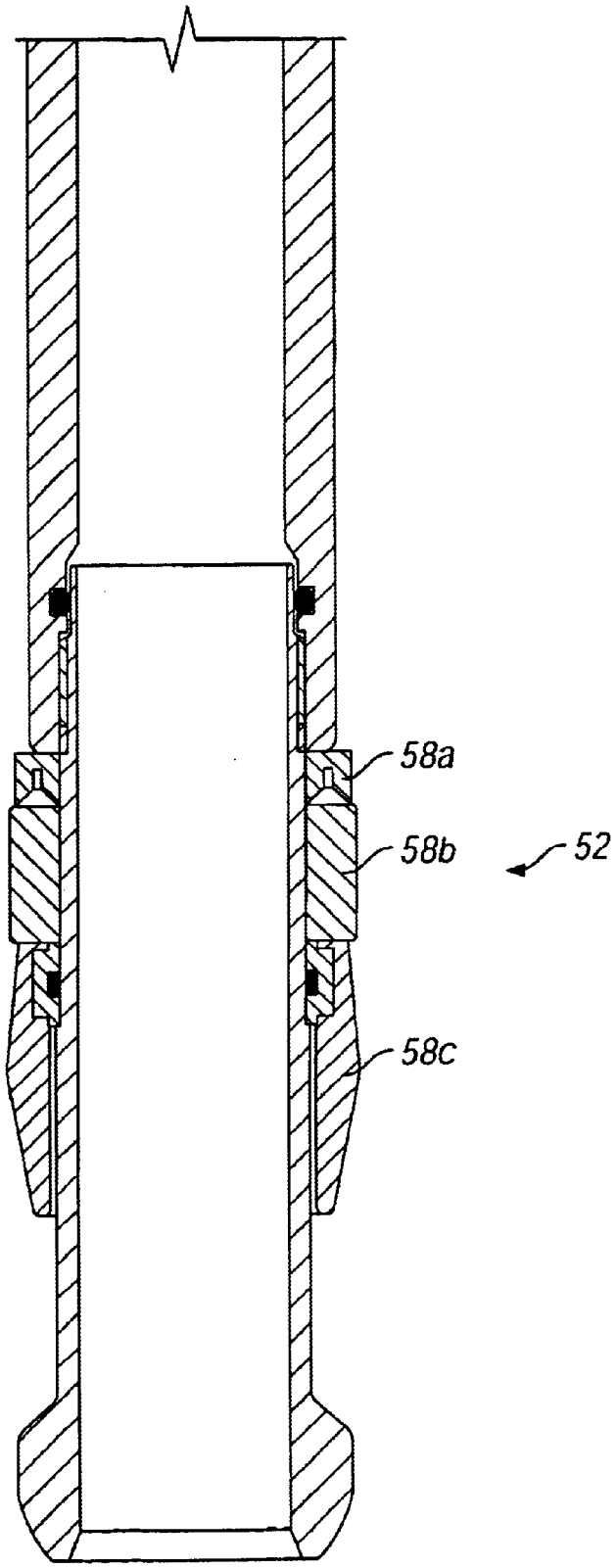
FIG. 5 is a detail of the second end of the mandrel according to the invention.

FIG. 5 shows a detail of the second end 52 of the mandrel 48. A seal set is shown engaging the outside surface of the mandrel. The seal set as shown in this embodiment contemplates 3 seals, 58*a*, 58*b* and 58*c*. The seals of the seal set are typically elastomeric material or rubber. These seals are selected from materials that can tolerate at least 15,000 psi.

While this invention has been described with emphasis on the preferred embodiments, it should be understood that within the scope of the appended claims, the invention might be practiced other than as specifically described herein.

What is claimed is:

1. A tree saver apparatus for preventing excess pressure on a christmas tree for a well, wherein the christmas tree comprises tubing, a master valve, a top valve, a second master valve, a wing valve, and wherein the apparatus comprises:

a. a hydraulic system comprising:

i. a piston connected to a piston rod;

ii. a cylinder connected to the piston;

iii. an upper plunger connected to the piston; and iv. a hand wheel connected to the upper plunger;

b. a connection having at least 3 outlets connected to the cylinder;

c. a frac wing valve connected to the connection having at least 3 outlets;

d. a frac valve having a first port and a second port, wherein the first port is connected to the connection having at least 3 outlets;

e. a mandrel with a first end and second end, wherein the first end is connected to the piston rod; and f. a landing bowl connected to the top valve.

2. The apparatus of claim 1, wherein the piston rod has a piston rod first end connecting to the mandrel and a piston rod second end connected to the piston.

3. The apparatus of claim 2, wherein the piston rod first end is a threaded male engagement with a threaded female mandrel first end.

4. The apparatus of claim 3, wherein the threaded engagements are ACME-type threads.

5. A method for extending the life of a christmas tree that connects to tubing, comprising the steps of:

a. closing a master valve of the christmas tree;

b. reducing pressure above the master valve to zero;

c. installing a tree saver apparatus on the christmas tree by connecting a landing bowl to a top valve, wherein the tree saver apparatus comprises:

i. a hydraulic system comprising:

1. a piston connected to a piston rod;
2. a cylinder connected to the piston;
3. an upper plunger connected to the piston; and
4. a hand wheel connected to the upper plunger;

ii. a connection having at least 3 outlets connected to the cylinder;

iii. a frac wing valve connected to the connection having at least 3 outlets;

iv. a frac valve having a first port and a second port, wherein the first port is connected to the connection having at least 3 outlets and the second port;

v. a mandrel with a first end and second end, wherein the first end is connected to the piston rod;

d. opening the master valve to pressure the christmas tree and the tree saver apparatus;

e. hydraulically moving the piston in the cylinder to contact landing bowl;

f. locking the landing bowl to the mandrel;

g. unscrewing the piston rod first end from first end of the mandrel;

h. hydraulically moving the piston in the cylinder to disengage landing bowl;

i. performing a production procedure;

j. upon completion of the production procedure, moving the piston using the hydraulic system to reattach piston rod first end with first end of mandrel;

k. releasing the first end of mandrel from landing bowl;

l. moving the piston to disengage the mandrel from the tubing at a point above the master valve;

m. closing the master valve;

n. bleeding off the pressure from the master valve; and o. removing the tree saver apparatus.

6. The method of claim 5, wherein the production procedure is fracing the well.

* * * * *